US008942615B2

(12) United States Patent
Salalha et al.

(10) Patent No.: US 8,942,615 B2
(45) Date of Patent: Jan. 27, 2015

(54) VORTEX FLOW RESISTERS

(75) Inventors: Wael Salalha, Galil (IL); Shunit Petachia, Netanya (IL); Sharon Nagler, Gan Yavna (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 167 days.

(21) Appl. No.: 13/699,493

(22) PCT Filed: Aug. 31, 2010

(86) PCT No.: PCT/US2010/047412

§ 371 (c)(1),
(2), (4) Date: Nov. 21, 2012

(87) PCT Pub. No.: WO2012/030330

PCT Pub. Date: Mar. 8, 2012

(65) Prior Publication Data

US 2013/0064591 A1 Mar. 14, 2013

(51) Int. Cl.
*G03G 21/00* (2006.01)
*G03G 15/10* (2006.01)

(52) U.S. Cl.
CPC ..... *G03G 15/104* (2013.01)
USPC ..... 399/348

(58) Field of Classification Search
USPC ..... 399/237, 346–348
See application file for complete search history.

(56) References Cited

U.S. PATENT DOCUMENTS

| | | | | |
|---|---|---|---|---|
| 5,323,700 | A | 6/1994 | Katsuyama et al. | |
| 5,666,143 | A | 9/1997 | Burke et al. | |
| 7,036,920 | B2 | 5/2006 | Rousseau et al. | |
| 7,303,265 | B1 | 12/2007 | Delametter et al. | |
| 7,458,671 | B2 | 12/2008 | Leighton et al. | |
| 2004/0234309 | A1 * | 11/2004 | Nagata et al. | 399/348 |
| 2005/0201785 | A1 * | 9/2005 | Gila et al. | 399/348 |
| 2009/0175665 | A1 * | 7/2009 | Wilde et al. | 399/348 |
| 2009/0297234 | A1 | 12/2009 | Cahill | |
| 2010/0085585 | A1 | 4/2010 | Stowe et al. | |

FOREIGN PATENT DOCUMENTS

| | | | |
|---|---|---|---|
| EP | 0364425 | A2 | 4/1990 |
| JP | 2001/305901 | A | 11/2001 |
| JP | 2003/091193 | A | 3/2003 |

OTHER PUBLICATIONS

International Searching Authority, International Search Report and Written Opinion, PCT/US2010/047412, 8 pages, May 26, 2011.

* cited by examiner

*Primary Examiner* — Walter L Lindsay, Jr.
*Assistant Examiner* — Rodney Bonnette
(74) *Attorney, Agent, or Firm* — Todd A. Rathe, Esq.; Todd Rathe

(57) ABSTRACT

Vortex flow resisters (20, 220) deliver liquid from an upper chamber (16, 216) to a lower chamber (18, 218) prior to the liquid being distributed onto a cylinder (12, 14, 212, 122).

15 Claims, 3 Drawing Sheets

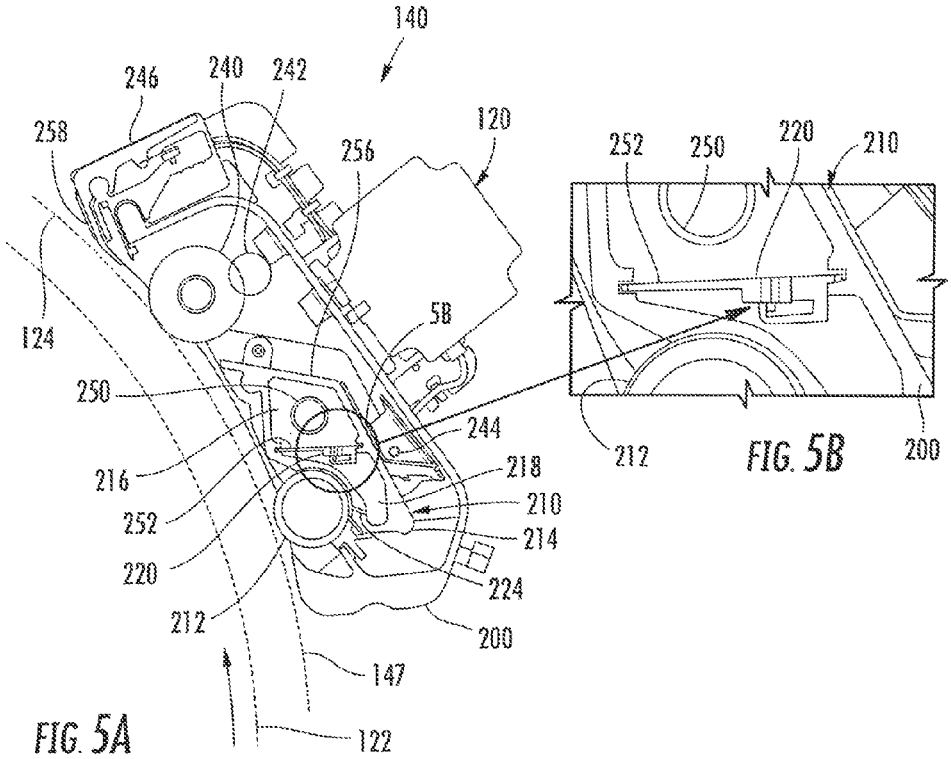
FIG. 5A
FIG. 5B
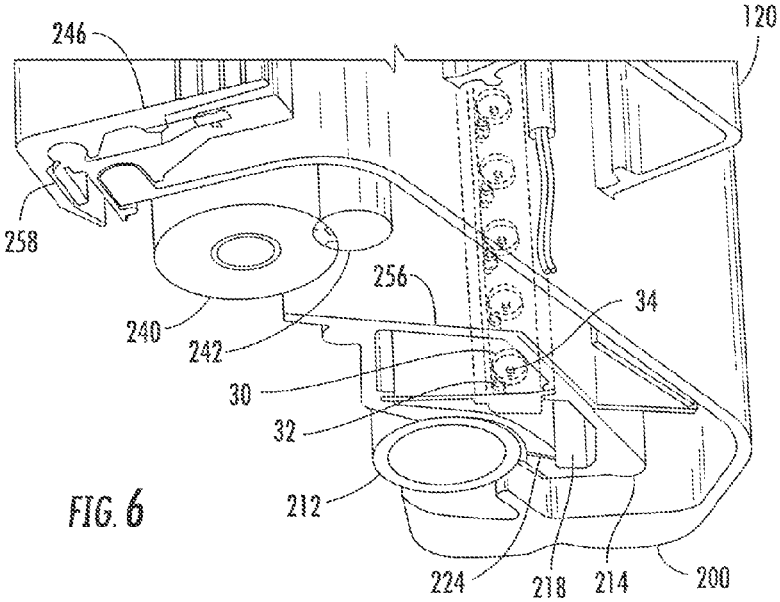
FIG. 6

VORTEX FLOW RESISTERS

This application claims priority from International Patent Application No. PCT/US2010/047412 filed Aug. 31, 2010, which is hereby incorporated by reference.

BACKGROUND

Distributing or dispensing liquid uniformly onto a cylinder is often difficult. In many applications, the non-uniform application of liquid to the cylinder may result in performance and quality issues.

BRIEF DESCRIPTION OF THE DRAWINGS

FIG. 5A is a sectional view of a cleaning station of the printer of FIG. 4 according to an example embodiment.

FIG. 5B is it an enlarged fragmentary sectional view of the cleaning station of FIG. 5.

FIG. 6 is a fragmentary perspective view of the cleaning station of FIG. 5A according to an example embodiment.

DETAILED DESCRIPTION OF THE EXAMPLE EMBODIMENTS

Figure 1:
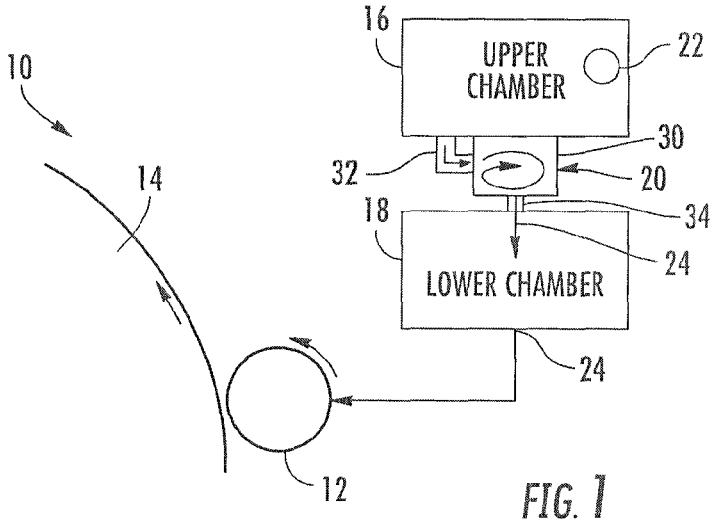
FIG. 1 is a schematic illustration of a liquid application system according to an example embodiment.

FIG. 1 schematically illustrates liquid application system 10 according to an example embodiment. Liquid application system 10 is configured to form a coating or layer of liquid on a cylinder with greater consistency such that the coating or layer has a more uniform thickness on a circumferential surface of the cylinder. Application system 10 includes cylinder 12, cylinder 14, upper chamber 16, lower chamber 18 and vortex flow resister 20.

Cylinder 12 comprises a rotatable cylinder that receives liquid from lower chamber 18. In the example illustrated, cylinder 12 is in contact or sufficiently near contact with cylinder 14 so as to transfer to receive liquid to cylinder 14. In one embodiment, cylinder 12 comprises a rotatably driven roller. In one embodiment, cylinder 12 may have an outer circumferential surface configured to absorb and carry the liquid being transferred to cylinder 14. In other embodiments, cylinder 12 may comprise a drum or other cylindrical member not associated with cylinder 14.

Cylinder 14 comprises a rotatable cylindrical member having an outer circumferential surface in contact with or in sufficiently close contact with cylinder 12 so as to receive liquid from cylinder 12. In one embodiment, cylinder 14 comprises a photo imaging drum having a photoconductive outer circumferential surface. In other embodiments, cylinder 14 may have other configurations depending upon a particular application. In some embodiments, cylinder 14 may be omitted.

Upper chamber 16 (schematically represented) comprises one or more structures forming an interior volume having an inlet 22. Upper chamber 16 supplies liquid to lower chamber 18 through vortex flow resister 20. Lower chamber 18 (schematically represented) comprises one or more structures forming an interior volume having an inlet 24 fluidly coupled to vortex flow resister 20 and an outlet 24 fluidly coupled to cylinder 12. In one embodiment, lower chamber 18 extends along and is fluidly coupled to cylinder 12 along at least a majority of an axial length of cylinder 12 so as to apply or distribute liquid to and along at least a majority of an axial length of cylinder 12.

For purposes of this disclosure, the term "fluidly coupled" shall mean that two are more fluid transmitting volumes are connected directly to one another or are connected to one another by intermediate volumes or spaces such that fluid may flow from one volume into the other volume. The term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Vortex flow resister 20 comprises one or more structures configured to receive liquid from upper chamber 16 and to direct such liquid in a vortex or whirlpool having a cycloid, whirling or helical shaped path prior to the liquid being discharged and distributed or applied to cylinder 12. Because vortex flow resister 20 causes received liquid to flow in such a whirling vortex or whirlpool, circling an axis prior to being discharged into lower chamber 18 and onto cylinder 12, vortex flow resister 20 provides a resistance against flow of liquid through resister 20, wherein the degree or extent of liquid flow resistance automatically changes in response to and based upon a velocity of the liquid entering resister 20. Said another way, resister 20 automatically dampens fluctuations or variations in flow velocity. In particular, when liquid enters resister 20 at a greater velocity, the liquid flow moves through a greater number of helixes or revolutions (as compared to liquid entering at a lesser velocity), slowing the flow to outlet 34. In contrast, when the liquid enters resister 20 at a lesser velocity, the liquid moves through a lesser number of helixes or revolutions. As compared to when liquid enters resister 20 at a greater velocity, when liquid enters resister 20 at a lesser velocity, liquid flow through resister 20 is not slowed as much due to the fewer number of revolutions that are completed prior to the liquid flow reaching outlet 34. As a result, liquid flow through resister 20 and to cylinder 12 is more uniform over time, experiencing smaller flow rate fluctuations despite potentially larger fluctuations in the rate at which liquid enters resister 20. Consequently, liquid flow to cylinder 12 is more uniform over time despite larger liquid flow variations that may occur over time.

According to one example embodiment in which lower chamber 18 extends along a majority of an axial length of cylinder 12 and applies liquid to at least a majority of the axial length of cylinder 12, includes a series of spaced resisters 20 also extending along at least a majority of the axial length of cylinder 12. As a result, not only are variations or fluctuations in liquid flow velocity over time dampened, but variations or fluctuations in liquid flow velocity across an axial length of cylinder 12 are also dampened. When liquid flow velocity into vortex flow resisters 20 at a first end of upper chamber 16 at a first end of cylinder 12 is greater than liquid flow velocity into resisters 20 at a second end of chamber 16 at a second end of cylinder 12, those resisters 20 at the first end of cylinder 12 will automatically provide a greater degree of dampening or a greater degree of resistance as compared to those resisters at the second end of cylinder 12. As a result, liquid flow to cylinder 12 is more uniform across an axial length of cylinder 12. This results in more uniform thickness of a coating of the liquid on cylinder 12. In the example illustrated, this also results in a more uniform coating of the liquid on cylinder 14.

Figure 2:
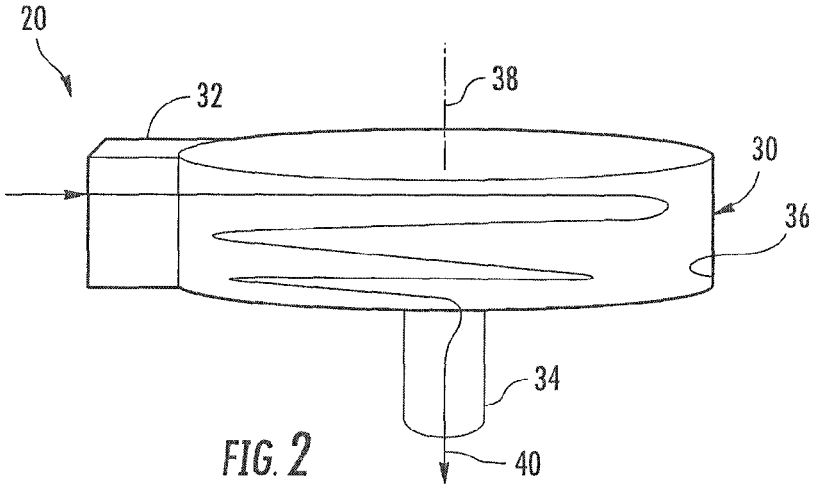
FIG. 2 is a perspective view of a vortex flow resister of the liquid application system of FIG. 1 according to an example embodiment.

FIG. 2 illustrates one example of vortex flow resister 20. As shown by FIG. 2, vortex flow resister 20 comprises chamber 30, inlet 32 and outlet 34. Chamber 30 comprises a volume in which liquid flow whirls in the vortex, helix or cycloid. In one example embodiment, chamber 30 has a cylindrical shape with circumferential sidewalls 36 encircling axis 38. The cylindrical sidewalls 36 further facilitate the helical flow of liquid within chamber 30, reducing dead spots in which liquid temporarily stagnates. In other embodiments, chamber 30 may have other shapes and configurations.

Inlet 32 is fluidly coupled to or fluidly communicates with the interior of chamber 30 such that liquid entering the interior of chamber 30 flows in a direction or along an axis eccentric to axis 38. In other words, liquid entering through inlet 32 is not centered across at axis 38, but is to one side of axis 38. As a result, helical flow within chamber 30 is achieved.

Outlet 34 is fluidly coupled to or fluidly communicates with the interior of chamber 30 proximate or at a bottom of chamber 30. Outlet 34 is fluidly coupled to cylinder 12 (shown in FIG. 1). After liquid within chamber 30 has completed flowing through its revolutions, the liquid within chamber 30 is discharged through outlet 34 as indicated by arrow 40. In the example illustrated, outlet 34 is also centered along axis 38. In other embodiments, outlet 34 may be offset from axis 38.

Figure 3A:
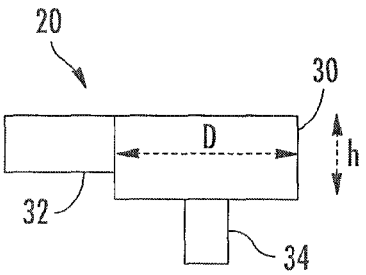
FIG. 3A is a side elevational view of the vortex flow resister of FIG. 2 according to an example embodiment.
Figure 3B:
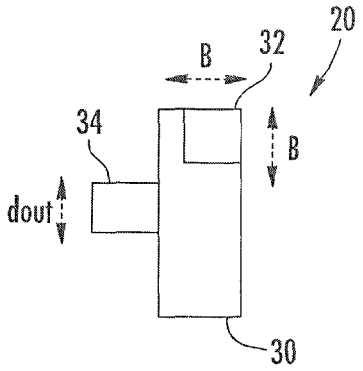
FIG. 3B is another side elevational view of the vortex flow resister of FIG. 2 according to an example embodiment.

FIGS. 3A and 3B further illustrate vortex flow resister 20, defining dimensions of one example embodiment for vortex flow resister 20. According to one example embodiment, chamber 30 has a height h of between 1 mm and 3 mm with a diameter D of between 2 mm and 10 mm. Inlet 32 has a cross-sectional area (a*a) of between 0.25 $mm^2$ and 4 $mm^2$. Although illustrated as square or rectangle, inlet 32 may have other cross-sectional shapes. Outlet 34 has a cross-sectional area of between 0.25 $mm^2$ and 4 $mm^2$. An example illustrated in which outlet 34 is cylindrical, outlet 34 has a diameter $d_{out}$ of between 0.5 mm and 2 mm. In other embodiments, vortex flow resister 20 may have other dimensions.

Figure 4:
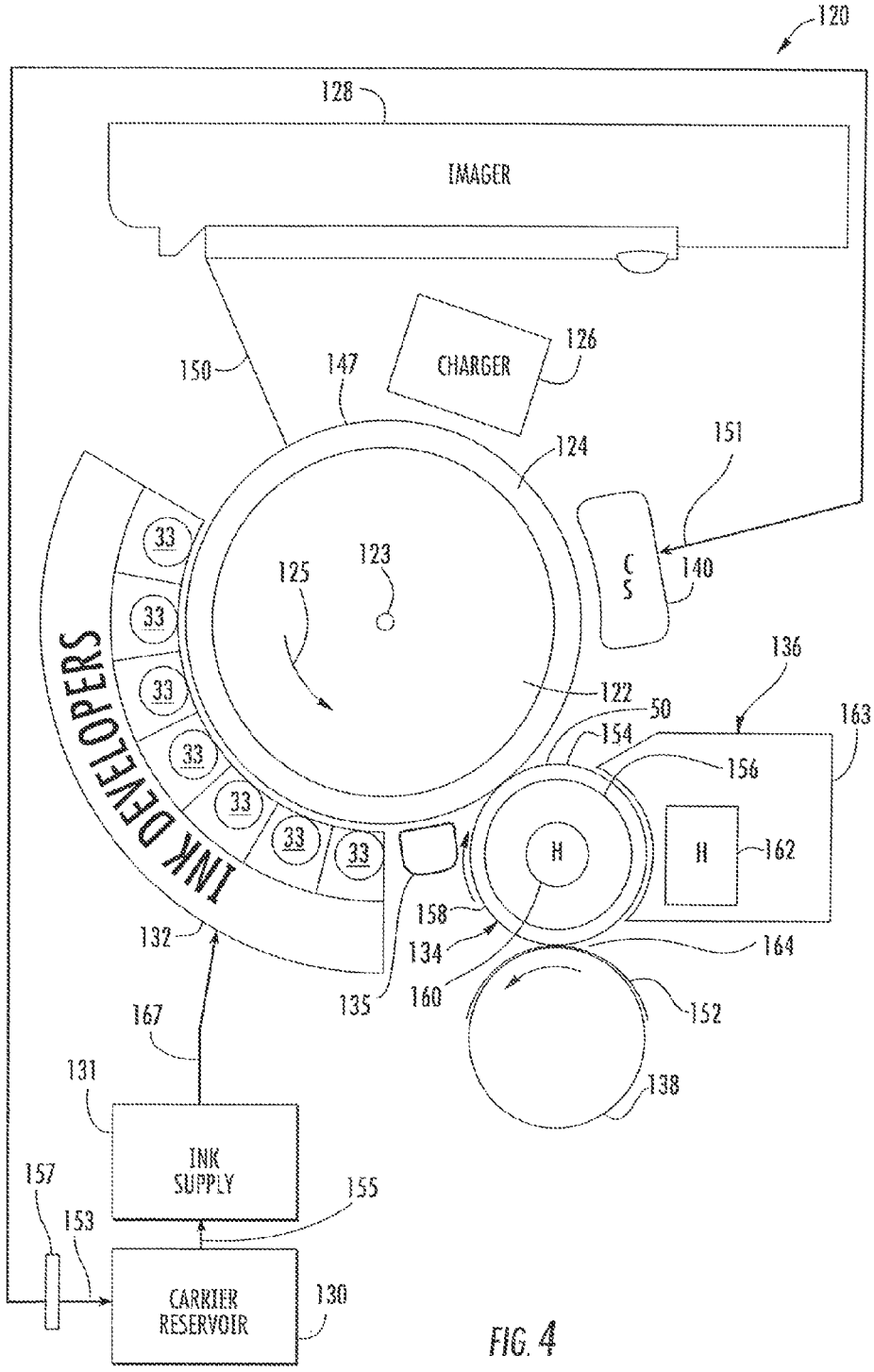
FIG. 4 is a schematic illustration of a printer including aspects of the liquid application system of FIG. 1 according to an example embodiment.

FIG. 4 schematically illustrates printer 120 incorporating aspects of liquid application system 10 described above according to an example embodiment. Printer 120 comprises a liquid electrophotographic (LEP) printer. Printer 120, (sometimes embodied as part of an offset color press) includes drum 122, photoconductor 124, charger 126, imager 128, ink carrier oil reservoir 130, ink supply 131, developer 132, internally and/or externally heated intermediate transfer member 134, heating system 136, impression member 138 and cleaning station 140. As will be described hereafter, cleaning station 140 utilizes vortex flow resisters to facilitate more uniform application of cleaning fluid or liquid to drum 122, reducing temperature variations across drum 122 and enhancing print performance.

Drum 122 comprises a movable support structure supporting photoconductor 124. Drum 122 is configured to be rotationally driven about axis 123 in a direction indicated by arrow 125 by a motor and transmission (not shown). As a result, distinct surface portions of photoconductor 124 are transported between stations of printer 120 including charger 126, imager 128, ink developers 132, transfer member 134 and charger 126. In other embodiments, photoconductor 124 may be driven between substations in other manners. For example, photoconductor 124 may be provided as part of an endless belt supported by a plurality of rollers.

Photoconductor 124, also sometimes referred to as a photoreceptor, comprises a multi-layered structure configured to be charged and to have portions selectively discharged in response to optical radiation such that charged and discharged areas form a discharged image to which charged printing material is adhered.

Charger 126 comprises a device configured to electrostatically charge surface 147 of photoconductor 124. In one embodiment, charger 126 comprises a charge roller which is rotationally driven while in sufficient proximity to photoconductor 124 so as to transfer a negative static charge to surface 147 of photoconductor 124. In other embodiments, charger 126 may alternatively comprise one or more corotrons or scorotrons. In still other embodiments, other devices for electrostatically charging surface 147 of photoconductor 124 may be employed.

Imager 128 comprises a device configured to selectively electrostatically discharge surface 147 so as to form an image. In the example shown, imager 128 comprises a scanning laser which is moved across surface 147 as drum 122 and photoconductor 124 are rotated about axis 123. Those portions of surface 147 which are impinged by light or laser 150 are electrostatically discharged to form an image (or latent image) upon surface 147. In other embodiments, imager 128 may alternatively comprise other devices configured to selectively emit or selectively allow light to impinge upon surface 147. For example, in other embodiments, imager 128 may alternatively include one or more shutter devices which employ liquid crystal materials to selectively block light and to selectively allow light to pass to surface 147. In yet other embodiments, imager 128 may alternatively include shutters which include micro or nano light-blocking shutters which pivot, slide or otherwise physically move between a light blocking and light transmitting states.

Ink carrier reservoir 130 comprises a container or chamber configured to hold ink carrier oil for use by one or more components of printer 120. In the example illustrated, ink carrier reservoir 130 is configured to hold ink carrier oil for use by cleaning station 140 and ink supply 131. In one embodiment, as indicated by arrow 151, ink carrier reservoir 130 serves as a cleaning station reservoir by supplying ink carrier oil to cleaning station 140 which applies the ink carrier oil against photoconductor 124 to clean the photoconductor 124. In one embodiment, cleaning station 140 further cools the ink carrier oil and applies ink carrier oil to photoconductor 124 to cool surface 147 of photoconductor 124. For example, in one embodiment, cleaning station 140 may include a heat exchanger or cooling coils in ink carrier reservoir 130 to cool the ink carrier oil. In one embodiment, the ink carrier oil supply to cleaning station 140 further assists in diluting concentrations of other materials such as particles recovered from photoconductor 124 during cleaning.

After ink carrier oil has been applied to surface 147 to clean and/or cool surface 147, the surface 147 is wiped with an absorbent roller and/or scraper. The removed carrier oil is returned to ink carrier reservoir 130 as indicated by arrow 153. In one embodiment, the ink carrier oil returning to ink carrier reservoir 130 may pass through one or more filters 157 (schematically illustrated). As indicated by arrow 155, ink carrier oil in reservoir 130 is further supplied to ink supply 131. In other embodiments, ink carrier reservoir 130 may alternatively operate independently of cleaning station 140, wherein ink carrier reservoir 130 just supplies ink carrier oil to ink supply 131.

Ink supply 131 comprises a source of printing material for ink developers 132. Ink supply 131 receives ink carrier oil from carrier reservoir 130. As noted above, the ink carrier oil supplied by ink carrier reservoir 130 may comprise new ink carrier oil supplied by a user, recycled ink carrier oil or a mixture of new and recycling carrier oil. Ink supply 131 mixes being carrier oil received from ink carrier reservoir 130 with pigments or other colorant particles. The mixture is applied to ink developers 132 as needed by ink developers 132 using one or more sensors and solenoid actuated valves (not shown).

In the particular example shown, the raw, virgin or unused printing material may comprise a liquid or fluid ink comprising a liquid carrier and colorant particles. The colorant particles have a size of less than 2μ. In different embodiments, the particle sizes may be different. In the example illustrated, the printing material generally includes approximately 3% by weight, colorant particles or solids part to being applied to surface 147. In one embodiment, the colorant particles include a toner binder resin comprising hot melt adhesive.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 132 comprises devices configured to apply printing material to surface 147 based upon the electrostatic charge upon surface 147 and to develop the image upon surface 147. According to one embodiment, ink developers 132 comprise binary ink developers (BIDs) circumferentially located about drum 122 and photoconductor 124. Such ink developers are configured to form a substantially uniform 6μ thick electrostatically charged layer composed of approximately 20% solids which is transferred to surface 147. In yet other embodiments, ink developers 132 may comprise other devices configured to transfer electrostatically charged liquid printing material or toner to surface 147.

Intermediate image transfer member 134 comprises a member configured to transfer the printing material upon surface 147 to a print medium 152 (schematically shown). Intermediate transfer member 134 includes an exterior surface 154 which is resiliently compressible and which is also configured to be electrostatically charged. Because surface 154 is resiliently compressible, surface 154 conforms and adapts to irregularities in print medium 152. Because surface 154 is configured to be electrostatically charged, surface 154 may be charged so as to facilitate transfer of printing material from surface 147 to surface 154.

Heating system 136 comprises one or more devices configured to apply heat to printing material being carried by surface 154 from photoconductor 124 to medium 152. In the example illustrated, heating system 136 includes internal heater 160, external heater 162 and vapor collection plenum 163. Internal heater 160 comprises a heating device located within drum 156 that is configured to emit heat or inductively generate heat which is transmitted to surface 154 to heat and dry the printing material carried at surface 154. External heater 162 comprises one or more heating units located about transfer member 134. According to one embodiment, heaters 160 and 162 may comprise infrared heaters.

Heaters 160 and 162 are configured to heat printing material to a temperature of at least 85° C. and less than or equal to about 140° C. In still other embodiments, heaters 160 and 162 may have other configurations and may heat printing material upon transfer member 134 to other temperatures. In particular embodiments, heating system 136 may alternatively include one of either internal heater 160 or external heater 162.

Vapor collection plenum 163 comprises a housing, chamber, duct, vent, plenum or other structure at least partially circumscribing intermediate transfer member 134 so as to collect or direct ink or printing material vapors resulting from the heating of the printing material on transfer member 134 to a condenser (not shown).

Impression member 138 comprises a cylinder adjacent to intermediate transfer member 134 so as to form a nip 164 between member 134 and member 138. Medium 152 is generally fed between transfer member 134 and impression member 138, wherein the printing material is transferred from transfer member 134 to medium 152 at nip 164. Although impression member 138 is illustrated as a cylinder or roller, impression member 138 and alternatively comprise an endless belt or a stationary surface against which intermediate transfer member 134 moves.

Cleaning station 140 comprises one or more devices configured to remove residual printing material from photoconductor 124 prior to surface areas of photoconductor 124 being once again charged at charger 126. FIGS. 5A, 5B and 6 illustrate cleaning station 140 in detail. Cleaning station 140 comprises housing 200, liquid application system 210, sponge roller 240, squeeze roller 242, drain 244 and wiper unit 246. Housing 200 comprises one or more structures substantially enclosing and supporting liquid application system 210, sponge roller 240, squeeze roller 242, drain 244 and wiper unit 246. In the example illustrated, housing 200 assists in channeling liquid, removed by sponge roller 240, to drain 244. In other embodiments, one or more of the components supported by housing 200 may be supported by other structures. In other embodiments, housing 200 may have other configurations.

Liquid application system 210 applies a cleaning liquid to photoconductor 124 supported by drum 122. As noted above, in the example illustrated, the cleaning liquid comprises ink carrier oil supplied by carrier reservoir 130 as indicated by arrow 151 (shown in FIG. 4). Liquid application system 210 of cleaning station 140 applies the ink carrier oil against photoconductor 124 to clean and to cool the photoconductor 124. In one embodiment, cleaning station 140 further cools the ink carrier oil before it is applied to photoconductor 124 to cool surface 147 of photoconductor 124. For example, in one embodiment, cleaning station 140 may include a heat exchanger or cooling coils in ink carrier reservoir 130 to cool the ink carrier oil. In one embodiment, the ink carrier oil supplied to cleaning station 140 further assists in diluting concentrations of other materials such as particles recovered from photoconductor 124 during cleaning. In other embodiments, liquid application system 210 of cleaning station 140 may be coupled to a separate source of ink carrier oil independent of carrier reservoir 130. In still other embodiments, liquid application system 210 may apply additional or different liquids to photoconductor 124.

Liquid application system 210 comprises wetting roller 212, flute 214 forming upper chamber 216 and lower chamber 218, and vortex flow resisters 220. Wetting roller 212 comprises a rotatable cylinder that receives liquid from lower chamber 218. Wetting roller 212 is supported in contact with or sufficiently near contact with photoconductor 124 so as to transfer the liquid (ink carrier oil) to photoconductor 124 on drum 122. In one embodiment, wetting roller 212 may have an outer circumferential surface configured to absorb and carry the liquid being transferred to photoconductor 124. In other embodiments, roller 212 may have a nonabsorbent, but compressible or flexible outer surface. In the example illustrated, wetting roller 212 extends into close proximity with flute 214 so as to function as a pump, pumping fluid to surface 147 of photoconductor 124. As a result, wetting roller 212 acts as an additional resister to further enhance uniformity of the thickness or amount of liquid applied to surface 147 of photoconductor 124.

Flute 214 comprises one or more structures that form upper chamber 216 and lower chamber 218. Upper chamber 216 comprises an interior volume having an inlet 250 through which cleaning liquid (ink carrier oil in the example embodiment) is applied into chamber 216. In the example embodiment, inlet 250 is fluidly coupled to carrier reservoir 130 as schematically shown in FIG. 4. In other embodiments, inlet 250 may be fluidly coupled to a separate independent source of cleaning liquid such as ink carrier oil. In other embodiments, flute 214 may have other sizes, shapes and configurations.

Lower chamber 218 comprises one or more structures forming an interior volume having fluidly coupled to vortex flow resister 220 and a slit 224 fluidly coupled to wetting roller 212. As shown by FIG. 6, lower chamber 218 extends along and is fluidly coupled to wetting roller 212 along at least a majority of an axial length of wetting roller 212 so as to apply or distribute liquid to and along at least a majority of an axial length of wetting roller 212. In the example illustrated, lower chamber 218 and its slit 224 continuously extend along an entire length of wetting roller 224. In other embodiments, slit 224 may comprise a plurality of spaced openings along an axial length of roller 212. Lower chamber 218 is separated from upper chamber 216 by a partition 252 which forms and supports vortex flow resisters 220.

Vortex flow resisters 220 are substantially identical to vortex flow resisters 20 shown and described above with respect to FIGS. 2, 3A and 3B. As shown by FIG. 6, each vortex flow resister 220 includes a chamber 30, an inlet 32 and an outlet 34 as described above with respect to vortex flow resister 20. Each vortex flow resister 220 is configured to receive liquid from upper chamber 16 and to direct such liquid in a vortex having a cycloid, whirling or helical shaped path prior to the liquid being discharged and distributed or applied to wetting roller 212. Because vortex flow resister 220 causes received liquid to flow in such a whirling vortex, circling an axis prior to being discharged into lower chamber 218 and onto cylinder 212, each vortex flow resister 220 provides a resistance against flow of liquid through resister 220, wherein the degree or extent of liquid flow resistance automatically changes in response to and based upon a velocity of the liquid entering resister 220. Said another way, each resister 220 automatically dampens fluctuations or variations in flow velocity. In particular, when liquid enters a particular resister 220 at a greater velocity, the liquid flow moves through a greater number of helixes or revolutions (as compared to liquid entering at a lesser velocity), slowing the flow to lower chamber 218 and wetting roller 212. In contrast, when the liquid enters resister 220 at a lesser velocity, the liquid moves through a lesser number of helixes or revolutions. As compared to when liquid enters resister 220 at a greater velocity, when liquid enters resister 220 at a lesser velocity, liquid flow through resister 220 is not slowed as much due to the fewer number of revolutions that are completed prior to the liquid flow reaching lower chamber 218 and wetting roller 212. As a result, liquid flow through resister 220 and to wetting roller 212 is more uniform over time, experiencing smaller flow rate fluctuations despite potentially larger fluctuations in the rate at which liquid enters resister 220. Consequently, liquid flow to wetting roller 212 is more uniform over time despite larger liquid flow variations that may occur over time. As a result, resisters 220 facilitate uniform application of liquid to photoconductor 124 about drum 122 even at relatively high flow rates and high linear speed velocities of coating of the order between 0.5 to 4 meters per second.

As shown by FIG. 6, resisters 220 extend and are spaced along at least a majority of the axial length of wetting roller 212. As a result, not only are variations or fluctuations in liquid flow velocity over time dampened, but variations or fluctuations in liquid flow velocity across an axial length of wetting roller 212 are also dampened. When liquid flow velocity into resisters 220 at or proximate a first end of wetting roller 212 is greater than liquid flow velocity into resisters 220 at a second end of wetting roller 212, those resisters 220 at the first end of wetting roller 212 will automatically provide a greater degree of dampening or a greater degree of resistance as compared to those resisters at the second end of wetting roller 212. Such dampening occurs over a large range of flow rates and under different inlet pressure conditions. As a result, liquid flow to wetting roller 212 is more uniform across an axial length of wetting roller 212. This results in a more uniform thickness for the coating of the liquid on wetting roller and ultimately a more uniform thickness of liquid applied to photoconductor 124.

By regulating and coordinating the flow rate produced by vortex resisters 220 and the flow rate or pump produced by the wetting roller 212, the flow rate to photoconductor 124 may be controlled for both uniformity and efficiency. In particular, if wetting roller 212, which acts as a pump, rotates faster than the flow of liquid through slit 224, a reverse meniscus higher than that at slit 224 prevents liquid from reaching the middle of the wetting roller 212, producing non-uniformity. This result is due to air being pumped by the higher velocity of wetting roller 212, preventing fluid from lower chamber 218 from reaching this area. Alternatively, when the velocity of wetting roller 212 is slower than the flow of liquid through slit 224, liquid is insufficiently pumped upward towards surface 147, with the liquid instead flowing downwards to the lower drain 244 of housing 200. In both circumstances, system efficiency and uniformity is negatively impacted. Because vortex flow resisters 220 facilitate enhanced liquid flow rate uniformity to slit, the rotational velocity of wetting roller 212 may be more consistently matched to the velocity of liquid being provided at slit to enhance uniformity. Because a uniform coating of liquid may be formed on surface 147 without having to pump excessive quantities of liquid, efficiency is also enhanced.

Because the liquid applied to photoconductor 124 also cools photoconductor 124, producing a uniform flow rate of cleaning liquid to photoconductor 124 also facilitates more uniform temperatures across photoconductor 124. Achieving uniform temperatures across photoconductor 124 enhances printing performance and quality by improving color consistency and uniformity of the images formed on photoconductor 124 and subsequently transferred to a print medium.

Sponge roller 240 of cleaning station 140 comprises a rotatable roller configured to remove liquid previously applied by wetting roller 212. In the example illustrated, sponge roller 240 has an absorbent outer surface in contact with or sufficiently close to surface 147 to remove such liquid. In other embodiments, sponge roller 240 may comprise other rollers formed from other materials.

Squeeze roller 240 comprises a rotatable roller in contact with sponge roller 240 so as to compress and squeeze sponge roller 240 to remove liquid absorbed and carried by sponge roller 240. Liquid removed by squeeze roller 240 is guided by a surface 256 of flute 214 towards drain 244. Drain 244 returns the liquid to carrier reservoir 130 through a filter 157 as indicated in FIG. 4. In other embodiments, drain 244 may alternatively be configured to return the removed liquid to other recipients.

Wiper unit 246 includes a deformable doctor blade 258 positioned so as to remove any remaining oil from surface 147 before surface 147 is rotated to a charging area of charger 126 (shown in FIG. 4). In other embodiments, wiper unit 246 may have other configurations or may be omitted.

In operation, ink developers 132 develop an image upon surface 147 by applying electrostatically charged ink having a negative charge. Once the image upon surface 147 is developed, charge eraser 135, comprising one or more light emitting diodes, discharges any remaining electrical charge upon such portions of surface 147 and ink image is transferred to surface 154 of intermediate transfer member 134. In the example shown, the printing material formed comprises and approximately 1.0μ thick layer of approximately 90% solids color or particles upon intermediate transfer member 134.

Heating system 136 applies heat to such printing material upon surface 154 so as to evaporate the carrier liquid of the printing material and to melt toner binder resin of the color and particles or solids of the printing material to form a hot melt adhesive. The heat applied to surface 154 is inherently transferred to surface 147. Thereafter, the layer of hot colorant particles forming an image upon surface 154 is transferred to medium 152 passing between transfer member 134 and impression member 138. In the embodiment shown, the hot colorant particles are transferred to print medium 152 at approximately 90° C. The layer of hot colorant particles cool upon contacting medium 152 on contact in nip 164.

These operations are repeated for the various colors for preparation of the final image to be produced upon medium 152. As a result, one color separation at a time is formed on a surface 154. This process is sometimes referred to as "multi—shot" process.

During each revolution of drum 122 and photoconductor 124, surface 147 is passed opposite to cleaning station 140. At cleaning station 140, wetting roller 212 applies a uniform thickness or coating of liquid to surface 147 to facilitate cleaning of surface 147. The liquid, ink carrier oil, further cools surface 147. As noted above, the temperature of surface 147 may have been elevated as a result of contacting heated surface 154 of transfer member 134. Cleaning station 140 compensates for the resulting heating of surface 147 by cooling surface 147 prior to the forming of the images on surface 147. As noted above, because a uniform thickness of liquid may be applied to surface 147, cleaning station 140 may more uniformly cool surface 147 to achieve a more uniform temperature across surface 147, enhancing subsequent image color consistency and uniformity. Sponge roller 240 absorbs and removes the liquid applied by wetting roller 212. Blade 258 removes any residual liquid and ink from surface 147. After leaving cleaning station 140, surface 147 of photoconductor 124 returns to the charging area of charger 126.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:
a cylinder;
an upper chamber having an inlet;
a lower chamber having an opening through which liquid is applied to the cylinder; and
vortex flow resisters between the upper chamber and the lower chamber.

2. The apparatus of claim 1, wherein the cylinder comprises a wetting roller configured to apply the liquid to a photoconductor and wherein the apparatus further comprises:
a liquid removing roller adapted to contact the photoconductor;
a squeeze roller against the liquid removing roller; and
a drain receiving liquid removed from the photoconductor by the liquid removing roller.

3. The apparatus of claim 2 further comprising a wiper unit, wherein the liquid removing roller is between the wetting roller and the wiper unit.

4. The apparatus of claim 2 further comprising a structure forming at least a portion of the upper chamber and at least a portion of the lower chamber , the structure forming a flow guiding surface configured to direct liquid from the squeeze roller to the drain.

5. The apparatus of claim 2 further comprising a housing receiving and supporting the wetting roller, the liquid removing roller, squeeze roller, the drain, the upper chamber, the lower chamber and the vortex flow resisters as a unit.

6. The apparatus of claim 2 further comprising:
the photoconductor;
ink developers along the photoconductor and configured to apply ink to the photoconductor;
a charging unit opposite to the photoconductor between the liquid removing roller and ink developers; and
a transfer system configured to transfer pigments of the ink from the photoconductor a print medium.

7. The apparatus of claim 6, wherein the transfer system comprises:
an intermediate cylinder opposite to the photoconductor; and
an impression cylinder opposite to the intermediate cylinder, wherein the intermediate cylinder and the impression cylinder receive the print medium therebetween.

8. The apparatus of claim 1, wherein the cylinder extends along an axis and wherein the vortex flow resisters are spaced along the axis.

9. The apparatus of claim 1, wherein each of the vortex flow resisters comprises:
a chamber;
an eccentric inlet to the chamber; and
an outlet on a bottom of the chamber.

10. The apparatus of claim 9, wherein the chamber has a diameter of between 2 mm and 10 mm, wherein the outlet has a cross-sectional area of between 0.25 $mm^2$ and 4 $mm^2$ and wherein the inlet has a cross-sectional area of between 0.25 $mm^2$ and 4 $mm^2$.

11. The apparatus of claim 9, wherein the chamber and the outlet are centered along a same axis.

12. A method comprising:

distributing a liquid along a length of a cylinder by:

supplying the liquid to an upper chamber;

flowing the liquid through the vortex flow resisters to a lower chamber; and directing the liquid from the vortex flow resisters e onto the cylinder.

13. The method of claim 12, wherein the directing the liquid from the vortex flow resisters comprises:

directing the liquid from the vortex flow resisters onto the cylinder, wherein the vortex flow resistors comprise: a chamber; an eccentric inlet to the chamber; and an outlet on a bottom of the chamber.

14. The method of claim 12 further comprising:

electrostatically charging a surface of the cylinder;

developing toner on the surface based upon different electrostatic charges on different portions of the surface; and transferring the toner developed on the surface from the surface to a print medium.

15. The method of claim 12 further comprising rotating the cylinder at a linear speed velocity of at least 0.5 meters per second while the liquid is directed onto the cylinder.

* * * * *

UNITED STATES PATENT AND TRADEMARK OFFICE

CERTIFICATE OF CORRECTION

PATENT NO. : 8,942,615 B2
APPLICATION NO. : 13/699493
DATED : January 27, 2015
INVENTOR(S) : Wael Salalha et al.

It is certified that error appears in the above-identified patent and that said Letters Patent is hereby corrected as shown below:

On the title page, item 75, Inventors, in column 1, line 3, delete "Gan Yavna" and insert -- Gan Yavne --, therefor.

In the claims

In column 10, line 31, in Claim 4, delete "chamber ," and insert -- chamber, --, therefor.

In column 10, line 45, in Claim 6, delete "a" and insert -- to a --, therefor.

In column 11, line 6, in Claim 12, delete "registers e" and insert -- registers --, therefor.

Signed and Sealed this
Fourteenth Day of June, 2016

Michelle K. Lee

Michelle K. Lee
*Director of the United States Patent and Trademark Office*